US005941255A

United States Patent [19]

Chen

[11] Patent Number: 5,941,255

[45] **Date of Patent: *Aug. 24, 1999**

[54] COSMETICS KIT, CONVERTIBLE CASE AND METHOD OF USE

[75] Inventor: Sung-Tsei Chen, Hacienda Heights, Calif.

[73] Assignee: Markwins International Coporation, La verne, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/092,359

[22] Filed: Jun. 5, 1998

[51] Int. Cl.[6] ..... A45D 27/22; B65D 43/14

[52] U.S. Cl. ..... 132/315; 132/294; 132/314; 132/295; 132/286; 206/581; 206/823; 220/761

[58] Field of Search ..... 132/286, 287, 132/294, 295, 296, 297, 301, 314, 315, 316, 291, 304; 190/21, 17, 29–35, 109; 206/581, 823, 372, 373, 566, 503, 508, 509, 443, 446; 220/500, 503, 522, 761; 312/127, 266

[56] References Cited

U.S. PATENT DOCUMENTS

| | | | |
|---|---|---|---|
| D. 258,470 | 3/1981 | Chun . | |
| D. 290,536 | 6/1987 | Nadel . | |
| D. 325,123 | 4/1992 | Tiramani . | |
| 480,709 | 8/1892 | Capitain . | |
| 719,298 | 1/1903 | Berry . | |
| 1,656,785 | 1/1928 | Foster | 132/315 |
| 1,739,890 | 12/1929 | Deitel . | |
| 1,752,948 | 4/1930 | Herrman . | |
| 1,778,522 | 10/1930 | Deitel . | |
| 1,808,961 | 6/1931 | Lyhne | 132/315 |
| 2,019,083 | 10/1935 | Loftin . | |
| 2,204,717 | 6/1940 | Younghusband | 132/315 |
| 2,529,569 | 11/1950 | Overton . | |
| 2,725,061 | 11/1955 | Keith . | |
| 2,761,458 | 9/1956 | Werber | 132/315 |
| 3,410,018 | 11/1968 | Woolworth . | |
| 3,565,305 | 2/1971 | Belokin, Jr. . | |
| 4,629,066 | 12/1986 | Howard . | |
| 4,796,735 | 1/1989 | Horiuchi . | |
| 5,257,509 | 11/1993 | Harris . | |
| 5,358,100 | 10/1994 | Wolff | 132/315 |
| 5,390,787 | 2/1995 | Macasaet . | |
| 5,515,954 | 5/1996 | Nordstrom . | |

*Primary Examiner*—Gene Mancene
*Assistant Examiner*—PhiloGene Pedro
*Attorney, Agent, or Firm*—Sheldon & Mak

[57] ABSTRACT

A cosmetics travel kit includes a case having a rectangular body with a floor and side walls projecting from the floor, a lid having a ceiling and side walls projecting from the ceiling, a stop member projecting inwardly from the lid side wall in spaced relation to the ceiling, and an inwardly facing anchor member; an implement carrier having a panel member and a retainer for cosmetic implements, first and second couplings for releasably holding the panel member in a closed position spaced within the lid for forming an openable lid storage cavity; and a supply of cosmetics selected from the set consisting of shadowing material, blushing material, lipstick, lip liner, coloring powder skin products, and coloring, calcium-bearing coating, and vitamin-bearing coating nail products. Also discloses is a method for grooming a user's fingernails.

17 Claims, 5 Drawing Sheets

COSMETICS KIT, CONVERTIBLE CASE AND METHOD OF USE

BACKGROUND

The present invention relates to cosmetics, cosmetics kits and cases therefor.

Typical cosmetics kits of the prior art include a pallette containing a supply of variously colored shadow and tint materials, a powder material, one or more implements for applying the materials, and an openable case for the above. The implements can include an applicator, a brush, a powder puff, and a mirror. A disadvantage of many existing cosmetics kits is that a very limited selection of make-up materials and implements is provided. Another disadvantage is that in examples having a greater selection of implements and materials the kits are difficult to use in that there is limited access for selection and use of the contents. Consequently, many existing cosmetics kits have plural make-up materials and implements that are undesirably difficult to access, yet being also undesirably limited in selection. The above problems are exacerbated when consideration is given to grooming of nails as well as skin of a user, in that additional materials such as nail polish and additional implements such as trimmers, cutters and files are needed.

Thus there is a need for a cosmetics kit that overcomes the disadvantages of the prior art.

SUMMARY

The present invention meets this need by providing a modular configuration having a movably supported implement carrier that secures a lid compartment of the case and provides a flat work surface for facilitating fingernail grooming, the case also providing conveniently accessed panels holding cosmetics materials. In one aspect of the invention, a cosmetics travel case includes a container having a rectangular body having a floor and side walls projecting from the floor, a lid having a ceiling and side walls projecting from the ceiling, the lid being movably connected to the body and having respective open and closed positions, the side walls of the body and the lid being edgewise adjacent in the closed position of the lid, the lid side wall having a stop member projecting inwardly therefrom in spaced relation to the ceiling, and an inwardly facing anchor member located opposite the stop member; an implement carrier having a panel member and a retainer for yieldably holding a plurality of cosmetic implements, a first coupling movably connected relative to a first edge extremity of the panel member for releasably engaging the anchor member with the first edge extremity spaced from the ceiling of the lid member, and a second coupling for releasably holding a second edge of the panel member proximate the stop member in a closed position of the implement carrier. Thus the panel member is spaced from the ceiling for forming a lid storage cavity between the ceiling and the panel member, the implement carrier also having an open position projecting out of the lid for opening the lid storage cavity.

The case can further include a pair of trays being movably supported relative to the body between respective adjacent retracted positions for permitting closure of the lid and respective extended positions projecting from the body. The side walls of the body can include front, back, left and right side walls, the lid having a pivot axis proximate an upper extremity of the back side wall of the body, and wherein trays project, respectively, over the left and right side walls for facilitating access to the implement carrier within the lid when the trays are in the deployed positions. The travel case can have a carry handle externally connected to the front side wall of the body, a first plurality of foot members downwardly projecting from the floor for supporting the body with the floor in parallel-spaced relation to a supporting surface, and a second plurality of foot members rearwardly projecting from the container opposite the handle for supporting the body spaced from the supporting surface with the floor perpendicular to the supporting surface. The travel case can further include a flexible member connected between inside surfaces of the lid and the back side wall of the body for covering the connection between the lid and the body.

Each of the trays can be supported by spaced pairs of parallel, pivotally-connected link members for fixed orientation parallel to the floor and arcuate movement between the retracted and deployed positions. The travel case can further include a support member inwardly projecting from one of the side walls of the body for supporting the trays in the retracted position thereof.

The first coupling can include a hinge member foldably connected along a first edge extremity of the panel member and a hook-loop fastener element, the anchor member being a mating hook-loop fastener element, the second coupling including a flexible tab member anchored to the lid proximate the stop member, the tab member and the panel member having mating hook-loop fastener elements anchored thereto. The retainer of the implement carrier can include a flexible pocket member, a first edge extremity of the pocket member being fastened along the first edge extremity of the panel member, the flexible member being anchored proximate the panel member at locations between the first edge extremity and an opposite second edge extremity of the flexible member for forming respective pockets therebetween; and an elastic strip member is anchored proximate the panel member at plural locations spaced from the pocket member for individually gripping the implements.

In another aspect of the invention, a cosmetics travel kit includes the case having the rectangular body with a floor and side walls projecting from the floor, the lid having a ceiling and side walls projecting from the ceiling, the stop member projecting inwardly from the lid side wall in spaced relation to the ceiling, and the inwardly facing anchor member; the implement carrier having the panel member and the retainer for the cosmetic implements, the first and second couplings for releasably holding the panel member in the closed position within the lid for forming the openable lid storage cavity; and a supply of cosmetics selected from the set consisting of shadowing material, blushing material, lipstick, lip liner, coloring powder skin products, and coloring, calcium-bearing coating, and vitamin-bearing coating nail products.

The travel kit can further include a rack for displaying and releasably holding at least a portion of the supply of cosmetics, the rack being removably supported in the case. The rack can be a bottom rack for placement in the body covering a major portion of the floor. The bottom rack can hold a two-way mirror, a pair of toe separators, and respective liquid vials of a plurality of nail colors, a top coat, and a smoothing coat.

The case can further include the pair of trays being movably supported relative to the body between respective adjacent retracted positions, the rack being one of first and second tray racks for placement in corresponding ones of the trays. Each tray rack holds a plurality of shadowing materials, a plurality of blushing materials, a plurality of lipsticks, a lip liner, and a powder material.

In a further aspect of the invention, a method for grooming a user's fingernails includes the steps of:

(a) providing a cosmetic make-up kit including a case having a body and a hingably connected lid; a plurality of nail implements releasably supported in the case by an implement carrier, the nail implements being selected from the set consisting of a cuticle nipper, cuticle scissors, a cuticle trimmer, and a file; a panel member having a stowed position within the lid and a deployed position projecting from the lid; and a supply of nail product selected from the set consisting of nail colorings, calcium-bearing coating, and vitamin-bearing coating;

(b) trimming the fingernails using at least one of the implements;

(c) moving the panel member from the stowed position to the deployed position;

(d) resting at least some of the user's fingers on the panel; and (e) applying the nail product to fingernails of fingers resting on the panel thereby grooming the fingernails.

DRAWINGS

These and other features, aspects, and advantages of the present invention will become better understood with reference to the following description, appended claims, and accompanying drawings, where:

DESCRIPTION

Figure 1:
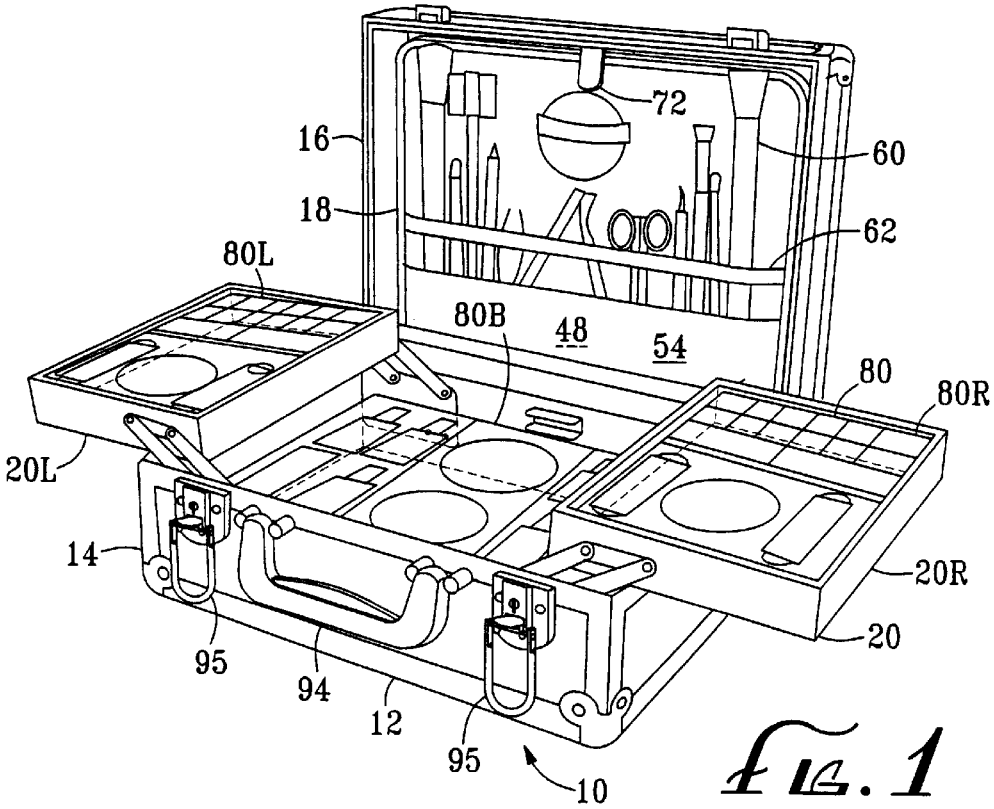
FIG. 1 is a perspective view of a cosmetics kit according to the present invention, the kit including a case being shown in an open condition.

The present invention is directed to modular cosmetics kit that is particularly effective in a variety of uses. With reference to FIGS. 1–10 of the drawings, a cosmetics kit 10 includes a case 12 having a body 14 and an openable lid 16, and a generally panel-shaped implement carrier 18 that is movably supportable in the case 12 as described below. Preferably, the case 12 further includes at least one tray 20 that is movable between retracted and deployed positions, the retracted position being vertically spaced above a floor 22 of the body 14, the deployed position being laterally displaced for facilitating access to a bottom compartment 23 within the body 14 beneath the retracted position of the tray 20.

Figure 2:
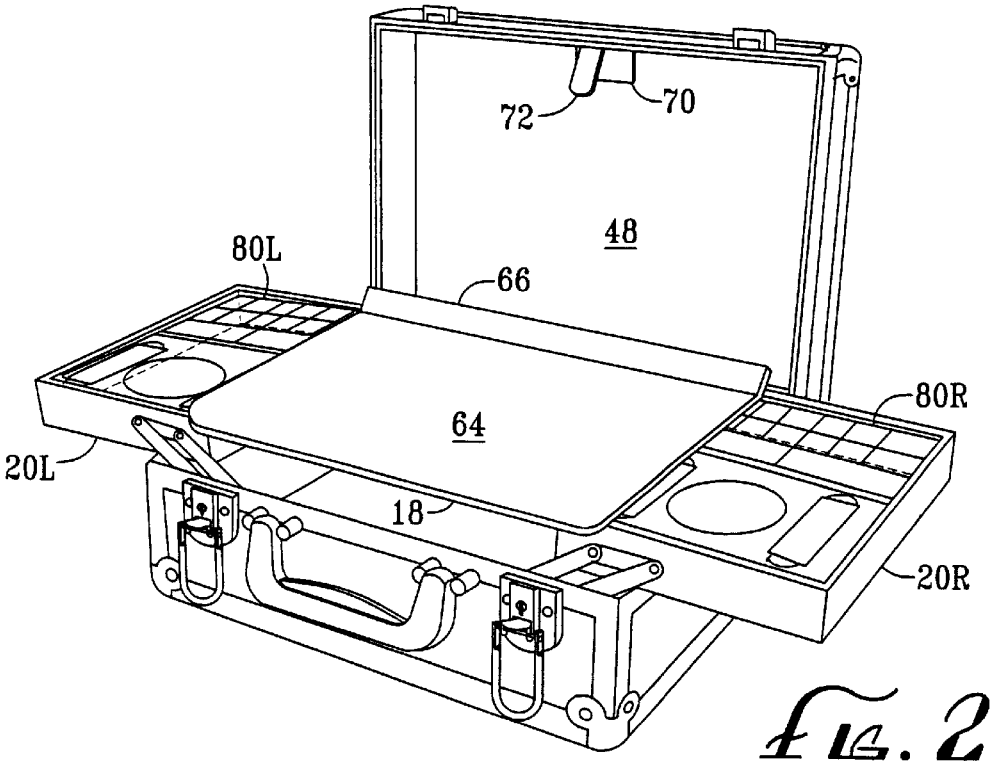
FIG. 2 is a perspective view as in FIG. 1, showing an implement carrier of the kit placed in a position projecting from a lid portion of the case of the kit.
Figure 3:
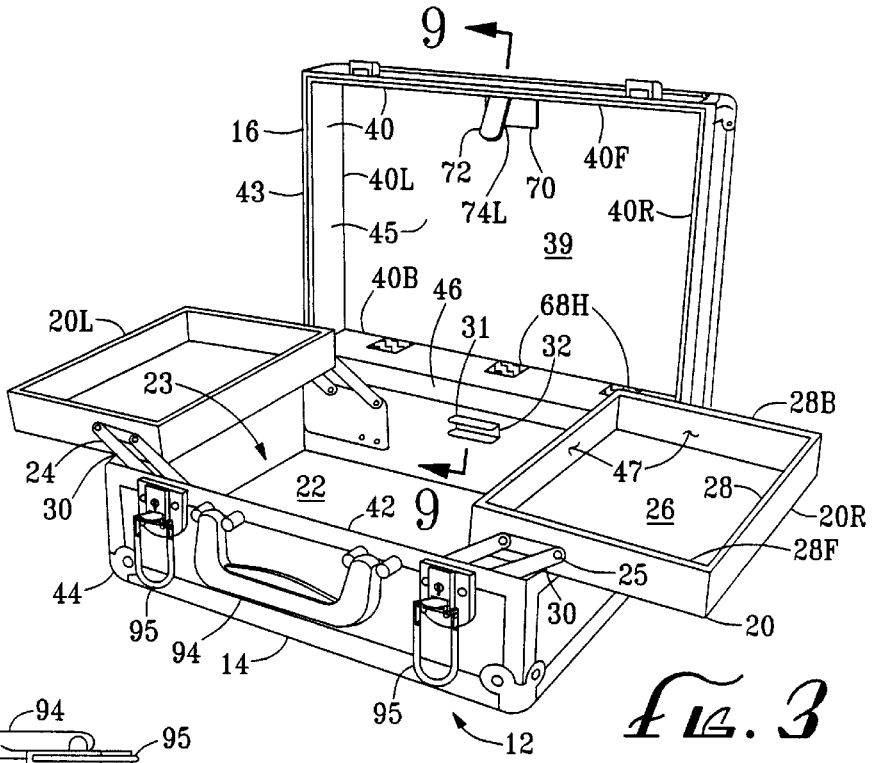
FIG. 3 is a perspective view as in FIG. 1, showing the implement carrier and panel inserts of the kit removed for showing further details of the case.

In the exemplary configuration as shown in FIGS. 1–3, there are two of the trays, designated left tray 20L and right tray 20R, each tray 20 being coupled to the body 14 by two pairs of link members 24 using a plurality of pivot pins 25 for maintaining the trays 20 oriented parallel to the floor 22 during arcuate movement between respective retracted and deployed positions. The trays 20 each have a rectangular bottom wall 26 and an upstanding perimeter wall 28, the body having upstanding side walls 30 including a back wall 30B, a front wall 30F, a left wall 30L, and a right wall 30R. More particularly, one pair of the link members 24 is parallel-connected between a perimeter wall front portion 28F of one of the trays 20 and the front wall 30F using a pivot pin 25 at each end of each link member 24, another pair of the link members 24 is similarly connected between a back portion 28B of the perimeter wall 28 and the back wall 30B. In the retracted positions of the trays 20, the respective bottom walls 26 are slightly below an upper extremity of the body 14, the perimeter walls 28 being closely spaced and extending upwardly out of the body 14, the combination of the trays 20 occupying substantially all of a plan area within the side walls 30. In the deployed positions, the trays 20 project outwardly over the left wall 30L and the right wall 30R, respectively. Preferably, the trays 20 move sufficiently outwardly for permitting visual access to all of the floor 22. It will be understood that by providing the link members 24 sufficiently long, and by suitably locating the pivot pins 25, the trays 20 can move from adjacent relation in the retracted positions to being completely clear of space between the left and right walls 30L and 30R of the body 14. The trays 20 can be supported in the retracted positions by the link members 24 coming into edge contact. Preferably the body can be provided with one or more support members 31 projecting inwardly from the side walls 30. As best shown in FIG. 3, a support member 31 is fastened to the back wall 30B by a pair of rivet fasteners 32 for supporting both of the trays 20 in the retracted positions.

Figure 4A:
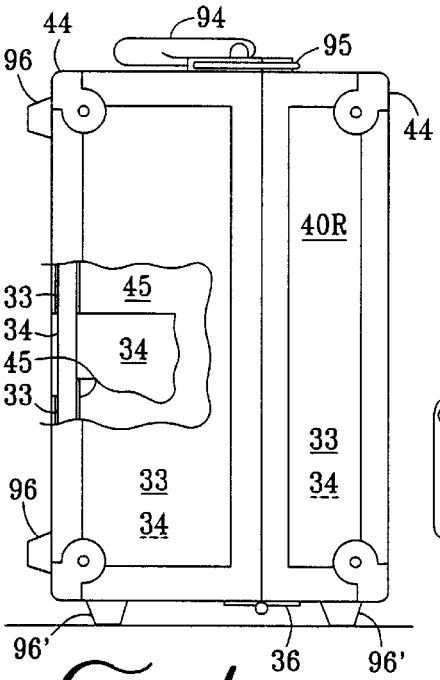
FIG. 4A is a side elevational view showing the case in a closed condition and standing upright in a carrying orientation.
Figure 4B:
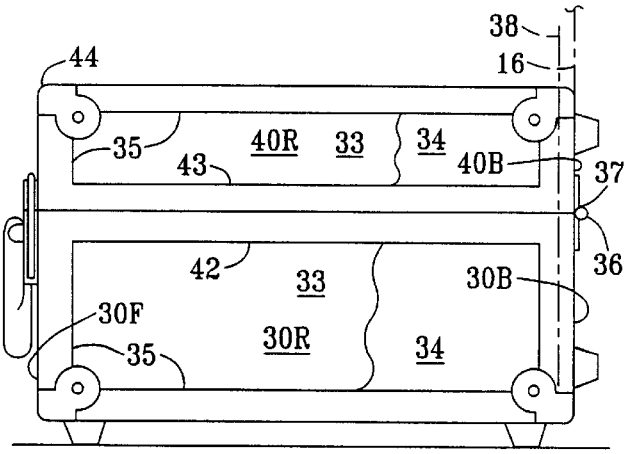
FIG. 4B is a side elevational view as in FIG. 4A, showing the closed case as normally oriented for use.

As further shown in FIGS. 4A and 4B, the floor 22 and the side walls 30 are formed as planar panels having an outer skin 33 of a durable material such as embossed aluminum sheet, a core 34 formed of a lightweight rigid material such as lauan plywood, the panels being connected by strip members 35 having slots formed therein for edgewise receiving the panels, the strip members 35 being typically formed of extruded aluminum in a conventional manner.

The lid 16 is connected to the back wall 30B by a pair of hinges 36 on a lid axis 37 that extends proximate an upper extremity of the back wall 30B, the lid 16 being pivotable approximately 90° between respective open and closed positions thereof, the open position clearing an inside surface plane 38 of the rear wall 30B for allowing free movement of the trays 20 and the links 24 between the retracted and deployed positions.

The lid 16 has a ceiling 39 and side walls 40 including a back wall 40B, a front wall 40F, a left wall 40L, and a right wall 40R, the side walls 40 of the lid 16 in the closed position thereof being edgewise adjacent to corresponding ones of the side walls 30 of the body. The construction of the lid 16 follows that of the body 14, the ceiling 39 and side walls 40 thereof each being formed using counterparts of the skin 33 and core 34 and being joined by the strip members 35. Further, facing edges of the body and lid side walls 30 and 40 are finished with interlocking counterparts of the strip members, the side walls 30 having body edge members 42, the side walls 40 having complementary lid edge members 43. Moreover, outside corners of the case 12 have convex protective cap members 44 fastened thereto. Inside surfaces of the body 14 and the lid 16 are provided with a liner 45 that is formed with a suitable sheet material such as felt or plush cloth, the liner 45 being anchored by a suitable adhesive such as contact cement. A flap portion 46 of the liner 45 forms a flexible bridge between the back walls 30B and 40B for hiding the hinges 36. The trays 20, which can be formed of a rigid material such as lauan or molded plastic are similarly provided with a covering 47 which can be formed of the same material as the liner 45.

A principal feature of the present invention is that the implement carrier 18 is movably supported by the lid 16, forming an openable lid compartment 48 as described herein. The carrier 18 includes a generally flat panel member 50, a front surface thereof having a liner 52 which can be formed of the same material as the liner 45, a pocket member 54 being joined along a bottom edge extremity 55 of the panel member. The pocket member 54 extends across the panel member 50, being anchored thereto along laterally spaced partition lines 56 that extend between the bottom edge extremity 55 and an upper edge extremity 57 of the pocket member 54 for forming respective pockets 58 between the partition lines 56. The pocket member 54 can be formed of a flexible material such as synthetic leather, the partition lines 56 being suitably spaced for receiving end extremities of a plurality of implements 60. The implement carrier 18 also includes an elastic member 62 that is fastened in parallel-spaced relation to the pocket member 54 at spaced apart locations on the liner 52 approximately in alignment with the partition lines 56 as indicated at 63 for releasably holding the implements 60 engaged with the pockets 58. The fastening of the elastic member 62 and the anchoring of the pocket member 54 can be by stitching to the liner 52, the liner 52 being bonded to the panel member 50 by a suitable adhesive such as the previously identified contact cement. As further shown in FIG. 8, the implements include a powder brush 60A, a blush brush 60B, a shading brush 60C, an eye groomer 60D, a pair of applicators 60E, a powder puff 60F, a nipper 60G, scissors 60H, a cuticle trimmer 60J, a file 60K, and tweezers 60L. The powder puff is retained separately by a counterpart of the elastic member, designated 62'. It will be understood that additional or alternative implements 60 can be included in the carrier 18.

Figure 9:
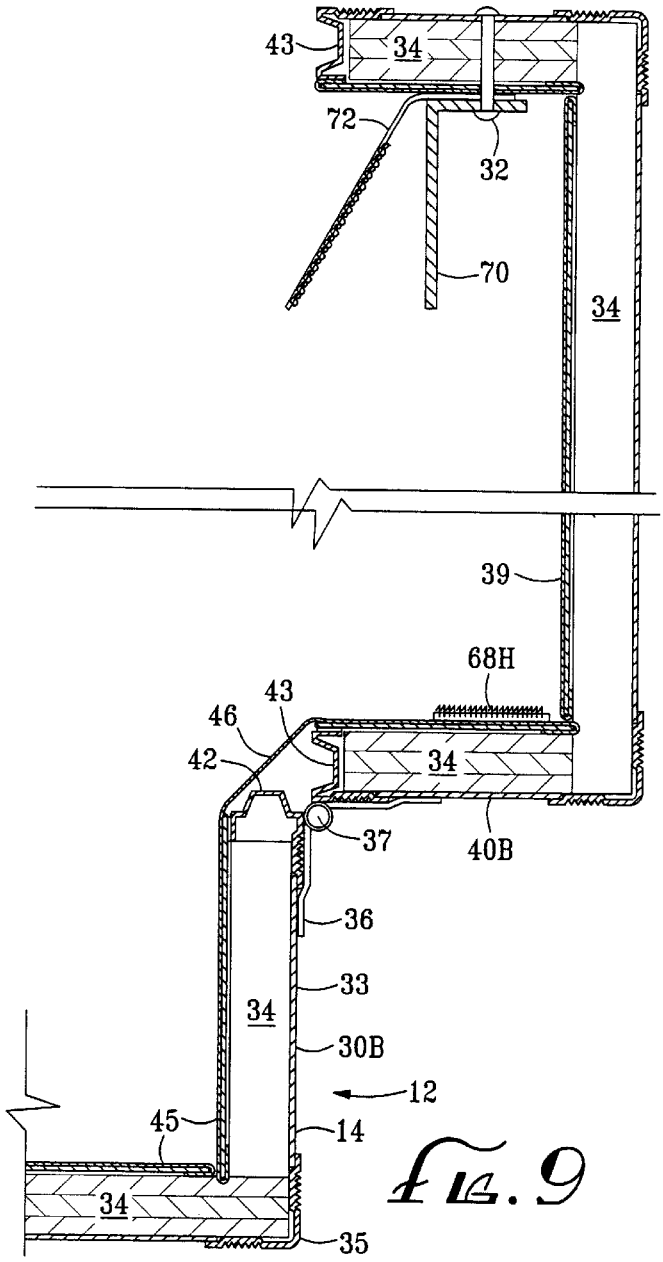
FIG. 9 is a fragmentary sectional view of the case of FIG. 1 on line 9—9 of FIG. 3.

In the exemplary configuration of the implement carrier 18 as described herein, a rear surface of the panel member 50 has a covering 64 being formed of a suitable material which can be the synthetic leather of the pocket member 54, the covering 64 extending beyond the bottom edge extremity 55 for forming a hinge member 66 by which the panel member 50 can be connected to the lid 16. More particularly, the covering 64 is folded at an edge extremity thereof for forming the hinge member by a double thickness of the covering 64, the covering 64 further extending between the panel member 50 and the liner 52, being bonded thereto by the previously identified adhesive. As shown in FIG. 9/*10, the hinge member 66 is releasably anchored to the back wall 40B of the lid 16 by coupling mating pairs of spaced apart hook-loop fasteners 68, respective inwardly facing hook elements 68H thereof being suitably fastened to a portion of the liner 45 along the back wall 40B, corresponding loop elements 68L thereof being fastened to the hinge member 66 by suitable means such as stitching. The loop elements 68L face in the same way as the pocket member 54, so that the bottom extremity 55 of the panel member 50 is spaced from the ceiling 49 at least by the width of the hinge member 66 when the fasteners 68 are engaged as shown in FIG. 9.

Figure 8:
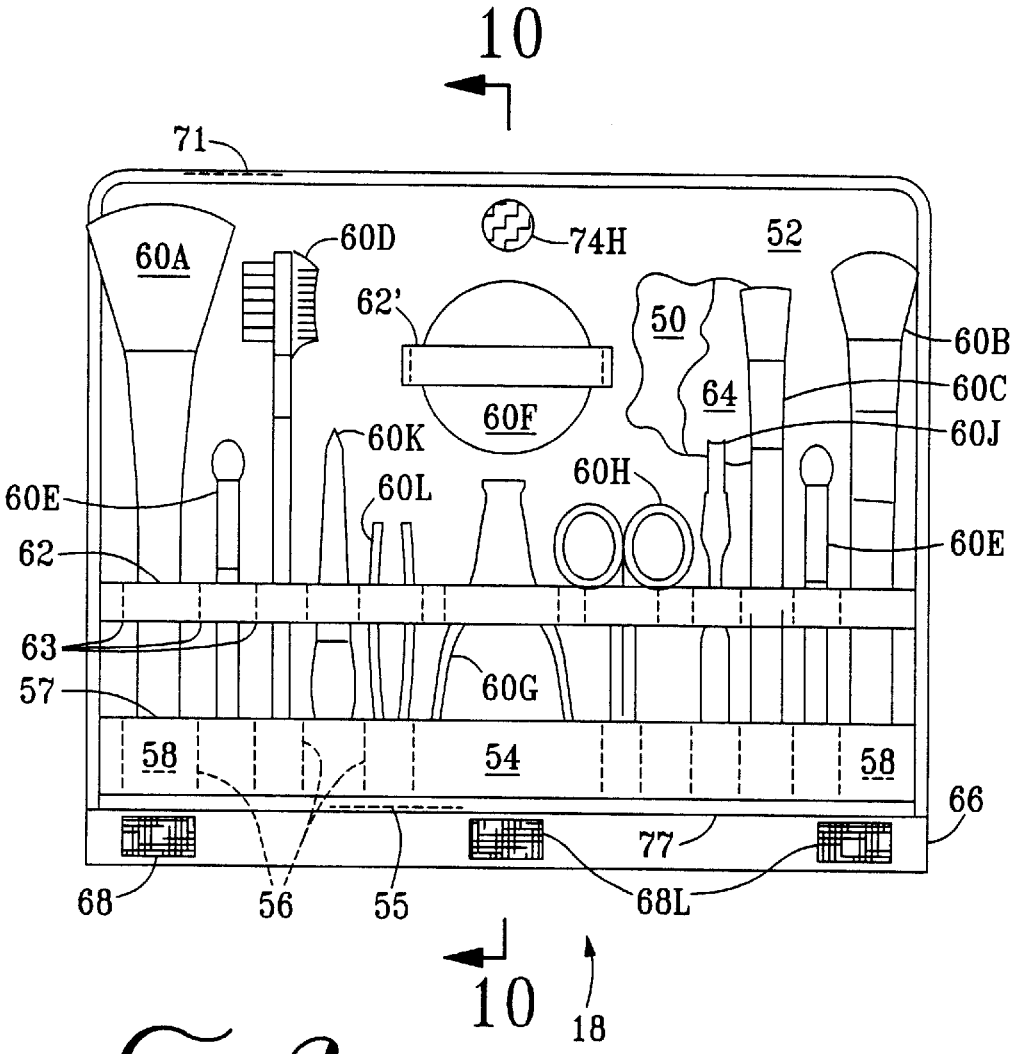
FIG. 8 is a front view of the implement carrier of the kit of FIG. 1.
Figure 10:
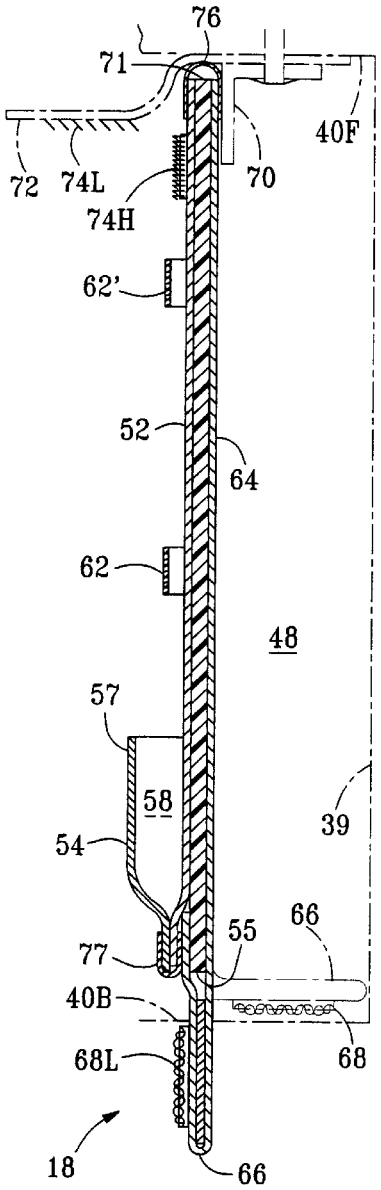
FIG. 10 is a fragmentary sectional view of the implement carrier of FIG. 1 on line 10—10 of FIG. 8.

In further accordance with the present invention, the front wall 40F of the lid 16 has an inwardly projecting stop member 70 fastened thereto by a counterpart of the rivet fastener 32. A top edge extremity 71 of the panel 50 is releasably supported against the stop member 70 by a flexible tab member 72 using a counterpart of the hook-loop fastener, designated 74, a loop element 74L thereof being affixed on the tab member 72, a hook element 74H thereof being affixed on the liner 52 proximate the top edge extremity 71. The tab member 72 is anchored by the counterpart rivet fastener 32, being clamped between the front wall 40F and the stop member 70. Accordingly, the panel member 50 is supported in spaced relation to the ceiling 39 by the combination of the hinge member 66 and the fasteners 68 locating the bottom edge extremity 55, the combination of the stop member 70, the strap member 72, and the fastener 74 locating the top extremity 71, thereby defining the lid cavity 48 of the case 12. As best shown in FIGS. 8 and 10, the implement carrier 18 is provided with a perimeter binding strip 76, and a retainer binding strip 77 for covering raw edges of the various material layers.

When the fastener 74 is released, the panel member of the implement carrier 18 is free to project out of the lid cavity 48 for access thereto. Also, the panel covering 66 on the back side of the panel member 50 is accessible as a working surface such as for writing and for supporting a users fingers during grooming thereof. More particularly, a groomer can use the panel member 50 as a steady-rest for supporting portions of the groomer's hands while working on the user's fingers that are also supported on the panel member 50. Opposite ends of the panel member 50 can rest on inwardly facing portions of the perimeter wall 28 of the trays 20, the pocket member 54, the elastic member 62, and implements 60 being retained thereby being suspended between the tray members 20. If desired, the implement carrier 18 can be completely detached from the lid 16 by further releasing the fasteners 68.

Figure 7:
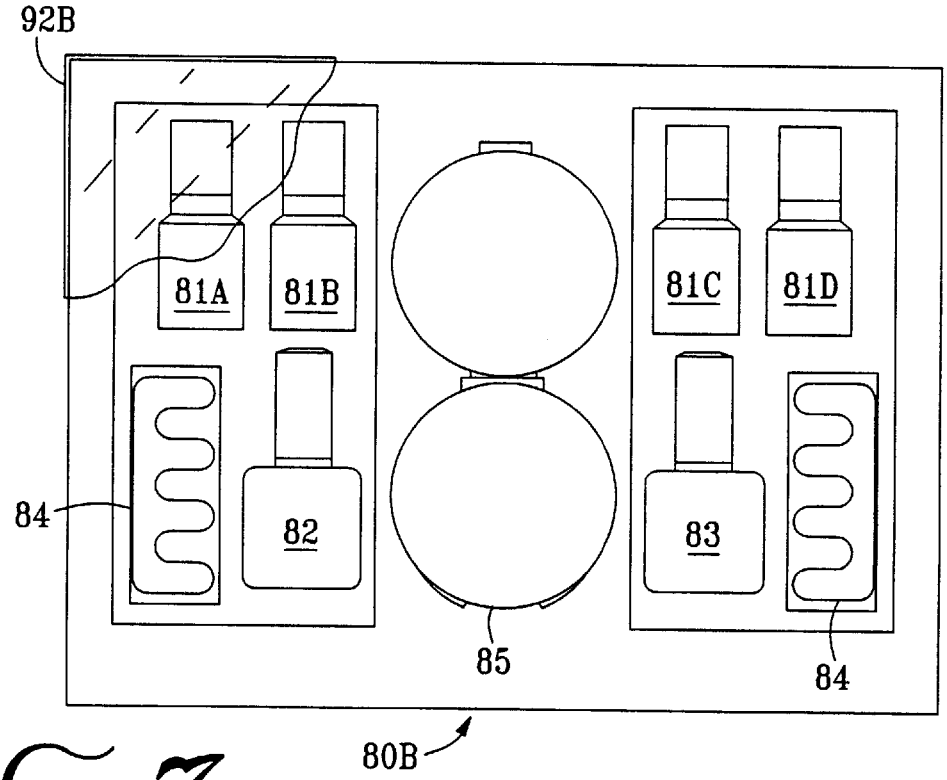
FIG. 7 is a plan view of a bottom display panel portion of the kit of FIG. 1

As further shown in FIG. 1, the cosmetics kit 10 further includes a plurality of display panels 80 for releasably holding a variety of cosmetic materials and additional implements for grooming the user. More particularly, the kit 10 includes a bottom panel 80B for placement in the bottom cavity 23, and a pair of tray panels 80L and 80R for placement in respective ones of the trays 20. Each of the display panels 80 can be a formed plastic member having respective cavities for releasably gripping or otherwise holding items of the kit. For example, an exemplary configuration of the bottom panel 80B as shown in FIG. 7 holds four vials 81 of nail color coating materials which can be lacquers, respectively designated 81A, 81B, 81C, and 81D, a vial 82 of a top coat which can be a commercially available calcium-enriched top coat, and a vial 83 of a smoothing base coat which can be a commercially available vitamin-enriched ceramic nail smooth. The bottom panel 80B also holds a pair of toe separators 84 and a two-way mirror 85.

Figure 5:
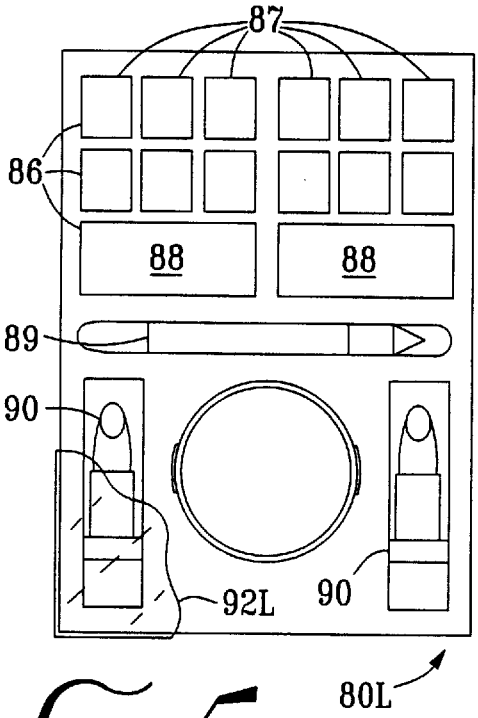
FIG. 5 is a plan view of a left tray display insert panel portion of the kit of FIG. 1.
Figure 6:
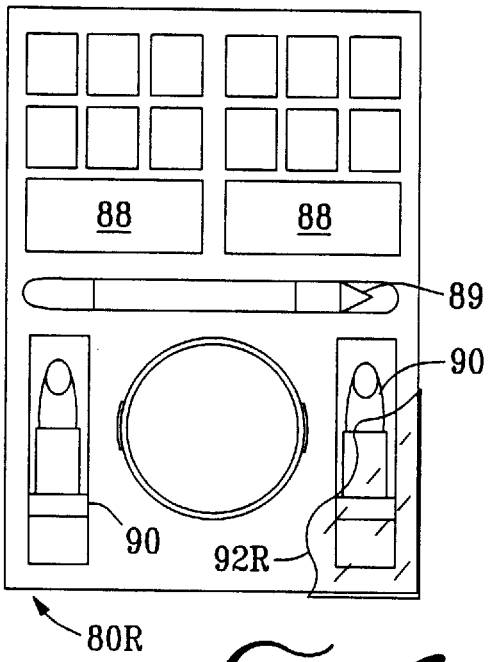
FIG. 6 is a plan view of a right tray display insert panel portion of the kit of FIG. 1.

The tray panels 80L and 80R each have respective depressions 86 formed therein for holding a plurality of shadow materials 87 and blush materials 88, a total of 24 differently colored shadow materials 87 and four differently colored blush materials 88 being provided in the tray panels 80 as shown in FIGS. 5 and 6. Each tray panel 80 also releasably holds a lip liner 89, a pair of lipsticks 90, and a powder material 91. More particularly, the tray panel 80L holds a bronzing powder material, designated 91B, and the tray panel 80R holds a wet-or-dry make-up material 91M. It will be understood that other and/or additional items can be supplied in the display panels 80. Further, each of the panels 80 can have a clear plastic cover 90, respectively designated 92B, 92L, and 92R.

As further shown in FIGS. 1–3, the case 12 is provided with a carry handle 94 being pivotally connected to the front panel 30F of the body 14, and a pair of latches 95 for securing the lid 16 in its closed position. As best shown in FIGS. 4A and 4B, four projecting feet 96 being located proximate respective corners of the floor 22 for elevating the floor in closely parallel-spaced relation to a planar supportive surface. Counterparts of the feet, designated 96', are similarly located on the back walls 30B and 40B for supporting the case 12 in an orthogonal orientation to be lifted carried by the handle 94 (or when the case 12 is being deposited on the supportive surface using the handle 94).

In an exemplary configuration of the kit 10 as described herein, the case 12 has outside measurements of approximately 12 inches in width, approximately 9 inches in depth, and 5.38 inches in height, corresponding inside measurements being approximately 11.31 inches, 8.31 inches, and 4.88 inches (of which 3 inches is within the body 14 and 2.88 inches within the lid 16), respectively. The panel member 50 of the implement carrier 18 measures approximately 10.75 inches wide and 8 inches deep, being spaced approximately 0.87 inches from the ceiling 39 when fastened within the lid 16 as described above. The trays 20 each have inside measurements of approximately 5.05 inches wide, 7.07 inches deep, and 1.0 inch high, the tray display panels 80L and 80R closely fitting inside the trays 20. The bottom display panel 80B measures approximately 10 inches wide, 8.25 inches deep, and 2.0 inches high.

Thus the present invention provides a cosmetics kit 10 and case 12 therefor that is particularly effective for extensive use while traveling to remote locations, the case 12 being advantageously compact yet suitable for holding and displaying a large collection of cosmetic materials and implements as described above.

Although the present invention has been described in considerable detail with reference to certain preferred versions thereof, other versions are possible. Therefore, the spirit and scope of the appended claims should not necessarily be limited to the description of the preferred versions contained herein.

What is claimed is:

1. A cosmetics travel case comprising:

(a) a container comprising a rectangular body having a floor and side walls projecting from the floor, a lid having a ceiling and side walls projecting from the ceiling, the lid being movably connected to the body and having respective open and closed positions, the side walls of the body and the lid being edgewise adjacent in the closed position of the lid, the lid side wall having a stop member projecting inwardly therefrom in spaced relation to the ceiling, and an inwardly facing anchor member located opposite the stop member;

(b) an implement carrier having a panel member, a retainer for yieldably holding a plurality of cosmetic implements, a first coupling movably connected relative to a first edge extremity of the panel member for releasably engaging the anchor member, the first edge extremity of the panel member being spaced from the ceiling of the lid member, and a second coupling for releasably holding a second edge of the panel member proximate the stop member in a closed position of the implement carrier wherein the panel member is spaced from the ceiling for forming a lid storage cavity between the ceiling and the panel member, the implement carrier also having an open position projecting out of the lid for opening the lid storage cavity.

2. The travel case of claim 1, wherein the case further comprises a pair of trays being movably supported relative to the body between respective adjacent retracted positions for permitting closure of the lid and respective extended positions projecting from the body.

3. The travel case of claim 2, wherein the side walls of the body include front, back, left and right side walls, the lid having a pivot axis proximate an upper extremity of the back side wall of the body, and wherein trays project, respectively, over the left and right side walls for facilitating access to the implement carrier within the lid when the trays are in the deployed positions.

4. The travel case of claim 3, having a carry handle externally connected to the front side wall of the body, a first plurality of foot members downwardly projecting from the floor for supporting the body with the floor in parallel-spaced relation to a supporting surface, and a second plurality of foot members rearwardly projecting from the container opposite the handle for supporting the body spaced from the supporting surface with the floor perpendicular to the supporting surface.

5. The travel case of claim 3, further comprising a flexible member connected between inside surfaces of the lid and the back side wall of the body for covering the connection between the lid and the body.

6. The travel case of claim 2, wherein each of the trays is supported by spaced pairs of parallel, pivotally-connected link members for fixed orientation parallel to the floor and arcuate movement between the retracted and deployed positions.

7. The travel case of claim 6, further comprising a support member inwardly projecting from one of the side walls of the body for supporting the trays in the retracted position thereof.

8. The travel case of claim 1, wherein the first coupling comprises a hinge member foldably connected along a first edge extremity of the panel member and a hook-loop fastener element, the anchor member being a mating hook-loop fastener element, and wherein the second coupling comprises a flexible tab member anchored to the lid proximate the stop member, the tab member and the panel member having mating hook-loop fastener elements anchored thereto.

9. The travel case of claim 8, wherein the retainer of the implement carrier comprises a flexible pocket member, a first edge extremity of the pocket member being fastened along the first edge extremity of the panel member, the flexible member being anchored proximate the panel member along spaced regions extending between the first edge extremity and an opposite second edge extremity of the flexible member for forming respective pockets therebeween, and an elastic strip member being anchored proximate the panel member at plural locations spaced from the pocket member.

10. A cosmetics travel kit comprising:

(a) a case comprising a rectangular body having a floor and side walls projecting from the floor, a lid having a ceiling and side walls projecting from the ceiling, the lid being movably connected to the body and having respective open and closed positions, the side walls of the body and the lid being edgewise adjacent in the closed position of the lid, the lid side wall having a stop member projecting inwardly therefrom in spaced relation to the ceiling, and an inwardly facing anchor member located opposite the stop member;

(b) an implement carrier having a panel member, a retainer for yieldably holding a plurality of cosmetic implements, a first coupling movably connected relative to a first edge extremity of the panel member for releasably engaging the anchor member, the first edge extremity of the panel member being spaced from the ceiling of the lid member, and a second coupling for releasably holding a second edge of the panel member proximate the stop member in a closed position of the implement carrier wherein the panel member is spaced from the ceiling for forming a lid storage cavity between the ceiling and the panel member, the implement carrier also having an open position projecting out of the lid for opening the lid storage cavity;

(c) a supply of cosmetics selected from the set consisting of shadowing material, blushing material, lipstick, lip liner, coloring powder skin products, and coloring, calcium-bearing coating, and vitamin-bearing coating nail products.

11. The travel kit of claim 10, further comprising a rack for displaying and releasably holding at least a portion of the supply of cosmetics, the rack being removably supported in the case.

12. The travel kit of claim 11, wherein the rack is a bottom rack for placement in the body covering a major portion of the floor.

13. The travel kit of claim 12, wherein the bottom rack holds a two-way mirror, a pair of toe separators, and respective liquid vials of a plurality of nail colors, a top coat, and a smoothing coat.

14. The travel kit of claim 11, wherein the case further comprises a pair of trays being movably supported relative to the body between respective adjacent retracted positions for permitting closure of the lid and respective extended positions projecting from the body, the rack being one of first and second tray racks for placement in corresponding ones of the trays.

15. The travel kit of claim 14, wherein each tray rack holds a plurality of shadowing materials, a plurality of blushing materials, a plurality of lipsticks, a lip liner, and a powder material.

16. The travel kit of claim 10, wherein the retainer of the implement carrier comprises a flexible pocket member, a first edge extremity of the pocket member being fastened along the first edge extremity of the panel member, the flexible member being anchored proximate the panel member along spaced regions extending between the first edge extremity and an opposite second edge extremity of the flexible member for forming respective pockets therebeween, and an elastic strip member being anchored proximate the panel member at plural locations spaced from the pocket member, and wherein the first coupling comprises a hinge member foldably connected along the first edge extremity of the panel member and a hook-loop fastener element, the anchor member being a mating hook-loop fastener element, and wherein the second coupling comprises a flexible tab member anchored to the lid proximate the stop member, the tab member and the panel member having mating hook-loop fastener elements anchored thereto.

17. A method for grooming a user's fingernails, comprising the steps of:

(a) providing a cosmetic make-up kit comprising:

(i) a case having a body and a hingably connected lid;

(ii) a plurality of nail implements releasably supported in the case by an implement carrier, the nail implements being selected from the set consisting of a cuticle nipper, cuticle scissors, a cuticle trimmer, and a file;

(iii) a panel member having a stowed position within the lid and a deployed position projecting from the lid; and (iv) a supply of nail product selected from the set consisting of nail colorings, calcium-bearing coating, and vitamin-bearing coating;

(b) trimming the fingernails using at least one of the implements;

(c) moving the panel member from the stowed position to the deployed position;

(d) resting at least some of the user's fingers on the panel; and (e) applying the nail product to fingernails of fingers resting on the panel thereby grooming the fingernails.

* * * * *